US007820277B2

(12) United States Patent
Bando et al.

(10) Patent No.: US 7,820,277 B2
(45) Date of Patent: Oct. 26, 2010

(54) WIPER AND METHOD FOR MANUFACTURING THE SAME

(75) Inventors: Takeshi Bando, Kagawa (JP); Daisuke Miyake, Kagawa (JP); Katsushi Tomita, Kagawa (JP); Hideyuki Ishikawa, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 133 days.

(21) Appl. No.: 11/082,503

(22) Filed: Mar. 17, 2005

(65) Prior Publication Data

US 2005/0221070 A1 Oct. 6, 2005

(30) Foreign Application Priority Data

Apr. 1, 2004 (JP) ..... 2004-109202

(51) Int. Cl.
*B32B 7/02* (2006.01)
*B32B 27/12* (2006.01)

(52) U.S. Cl. ..... 428/218; 442/381; 442/383; 442/384; 442/387; 442/388

(58) Field of Classification Search ..... 442/381, 442/385, 389, 383, 384, 387, 388; 428/218
See application file for complete search history.

(56) References Cited

U.S. PATENT DOCUMENTS

| | | | | |
|---|---|---|---|---|
| 3,649,429 | A * | 3/1972 | Hughes | 428/91 |
| 3,663,161 | A * | 5/1972 | Litzler et al. | 8/614 |
| 4,275,105 | A * | 6/1981 | Boyd et al. | 428/198 |
| 4,885,204 | A * | 12/1989 | Bither et al. | 442/385 |
| 5,525,397 | A * | 6/1996 | Shizuno et al. | 428/138 |
| 6,066,388 | A * | 5/2000 | Van Kerrebrouck | 428/218 |
| 6,177,370 | B1 | 1/2001 | Skoog et al. | |
| 6,573,204 | B1 | 6/2003 | Philipp et al. | |
| 2003/0135181 | A1 * | 7/2003 | Chen et al. | 604/374 |

FOREIGN PATENT DOCUMENTS

| | | |
|---|---|---|
| EP | 0826811 | 3/1998 |
| EP | 0865755 | 9/1998 |
| EP | 1151716 | 11/2001 |
| JP | 03152255 | 6/1991 |
| JP | 09098920 | 4/1997 |
| JP | 3183818 | 4/2001 |
| JP | 3333718 | 7/2002 |
| JP | 2003180593 | 7/2003 |

OTHER PUBLICATIONS

Patent Abstracts of Japan for JP 03-000860 published Jan. 7, 1991.

* cited by examiner

*Primary Examiner*—Elizabeth M Cole
(74) *Attorney, Agent, or Firm*—Brinks Hofer Gilson & Lione

(57) ABSTRACT

Disclosed is a wiper which is which is highly retentive of water, soft to the touch, and improved in sheet strength and a method for manufacturing the same. An interlining layer contains pulp fibers, first and second surfacing layers contain non-fusible fibers, and a reinforcing layer contains fusible fibers and rayon fibers. The fusible fibers are fusion-bonded but the non-fusible fibers remain unfused. Sheet surfaces are free from the fusible fibers.

14 Claims, 2 Drawing Sheets

WIPER AND METHOD FOR MANUFACTURING THE SAME

BACKGROUND OF THE INVENTION

1. Field of the Invention

The present invention relates to a wiper intended to be used for wiping the human body, furniture, home fixtures and so on in a pre-moistened or dry state and a method for manufacturing the same.

2. Description of the Related Art

Nonwoven wipers have been widely used to wipe the human body, furniture, home fixtures and so on. Such wipers may be used in a dry state to absorb water during use or in a pre-moistened state. In either case, nonwoven wipers are formed of hydrophilic fibers such as rayon and synthetic resin fibers.

Japanese Patent No. 3183818 discloses a wet tissue in which an interlining layer is disposed between upper and lower layers. The upper and lower layers contain hydrophobic fibers at a higher proportion than hydrophilic fibers whereas the interlining layer contains hydrophilic fibers at a higher proportion than hydrophobic fibers. Fibers constituting these layers are entangled, fusion-bonded or entangled and fusion-bonded to impart a sufficient strength to a nonwoven fabric. In this wet tissue, the hydrophilic fibers function to retain water. With the hydrophobic fibers appearing on the tissue surfaces, moreover, the wet tissue is allowed to easily separate from another wet tissue.

Japanese Patent No. 3333718 discloses a wiper stack in which each wiper comprises two fibrous web layers of hydrophilic fibers, polyester fibers and heat-fusible fibers (or thermally bondable fibers) and a pulp fiber layer interposed therebetween. These layers are entangled and integrated together by high-pressure water streams, and the heat-fusible fibers are fusion-bonded to each other. Because the pulp fiber layer is provided as an interlining layer, this wiper is capable of retain much water and doesn't feel sticky to the touch.

In these wipers disclosed in Japanese Patent Nos. 3183818 & 3333718, the heat-fusible fibers are fusion-bonded to each other in the upper and lower surfacing layers between which the interlining layer is interposed to retain water. Thus, the fusion-bonded fibers appear on the sheet surface and make the sheet surface hard due to immovability. Accordingly, the wipers tend to irritate the skin when used for wiping the human body.

Unlike the Japanese Patent Nos. 3183818 & 3333718, there may be developed a wet tissue not containing heat-fusible fibers. However, just entangling hydrophilic fibers and synthetic resin fibers will result in decreased sheet strength, particularly decreased wet strength, so that when the wet tissue is used for wiping, it is likely that fibers fall out of the sheet surface or the sheet itself is broken.

SUMMARY OF THE INVENTION

The present invention has been developed in view of the shortcomings in the prior art set forth above. It is therefore an object of the present invention to provide a wiper which is highly retentive of water, soft to the touch, and improved in sheet strength.

Another object of the present invention is to provide a method for manufacturing the same.

According to a first aspect of the invention, there is provided a wiper in the form of a sheet comprising:

a first surfacing layer appearing on one sheet surface;

a second surfacing layer appearing on the other sheet surface;

a reinforcing layer comprising fusible fibers; and an interlining layer comprising hydrophilic fibers, the reinforcing layer and the interlining layer being located between the first and second surfacing layers, the first and second surfacing layers comprising non-fusible fibers whose surface has a higher melting point than that of the fusible fibers or is not allowed to melt, wherein the fusible fibers are fusion-bonded while the non-fusible fibers remain unfused.

The wiper of the invention is highly retentive of water due to the presence of the interlining layer comprised of hydrophilic fibers. Since the surfacing layers are comprised of non-fusible fibers, fibers located on the sheet surfaces are kept in a relatively freely movable state to provide a soft feeling. Thus, the sheet surfaces hardly irritate the skin when used for wiping the human body, and the coefficient of friction between the sheet surfaces and an object to be cleaned is lowered to facilitate sliding. On the other hand, the wiper has an increased sheet strength because the reinforcing layer comprised of fusible fibers is disposed inside the sheet and the fusible fibers are fusion-bonded.

Preferably, the hydrophilic fibers contained in the interlining layer are cellulosic fibers having a fiber length equal to or less than 10 mm and the interlining layer has a higher density than the first and second surfacing layers. This leads to higher water retentivity of the sheet and enables water contained in the interlining layer to gradually come out of the sheet surfaces when a pressure is exerted thereon during wiping.

Also preferably, the non-fusible fibers constituting the first surfacing layer and/or the second surfacing layer are at least either of synthetic resin fibers or cellulosic fibers having a fiber length in the range of 20 to 70 mm. If the surfacing layer is comprised only or mainly of synthetic resin fibers, the sheet surface can be prevented from being excessively moistened to provide a sticky feeling to the skin. If the surfacing layer is comprised only or mainly of cellulosic fibers, on the other hand, water adhered to an object to be cleaned can be readily absorbed when the wiper is used in a dry state.

Here, the reinforcing layer may contain non-fusible fibers in addition to the fusible fibers. In this case, the non-fusible fibers are preferably hydrophilic fibers, more preferably cellulosic fibers having a fiber length in the range of 20 to 70 mm.

According to a second aspect of the present invention, there is provided a method for manufacturing a wiper comprising:

forming a multilayered fibrous web with a reinforcing layer-forming fibrous web and an interlining layer-forming fibrous web located between a first surfacing layer-forming fibrous web and a second surfacing layer-forming fibrous web, the reinforcing layer-forming fibrous web comprising fusible fibers, the interlining layer-forming fibrous web comprising hydrophilic fibers, the first surfacing layer-forming fibrous web and the second surfacing layer-forming fibrous web comprising non-fusible fibers whose surface has a higher melting point than that of the fusible fibers or is not allowed to melt, integrating the multilayered fibrous web through a water-jet treatment; and heat-treating the integrated multilayered fibrous web at such a temperature as to melt the surface of the fusible fibers but not melt the surface of the non-fusible fibers.

According to this method, a wiper which is highly retentive of water, soft to the touch, and improved in sheet strength can be relatively easily manufactured.

In the above method, preferably, cellulosic fibers having a fiber length equal to or less than 10 mm are deposited to form the interlining layer-forming fibrous web. Also preferably, at least either of synthetic resin fibers or cellulosic fibers having a fiber length in the range of 20 to 70 mm are deposited to form the first surfacing layer-forming fibrous web and/or the second surfacing layer-forming fibrous web. Here, the reinforcing layer-forming fibrous web may contain non-fusible fibers in addition to the fusible fibers.

BRIEF DESCRIPTION OF THE DRAWINGS

The present invention will be understood more fully from the detailed description given hereinafter and from the accompanying drawings of the preferred embodiments of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiments according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
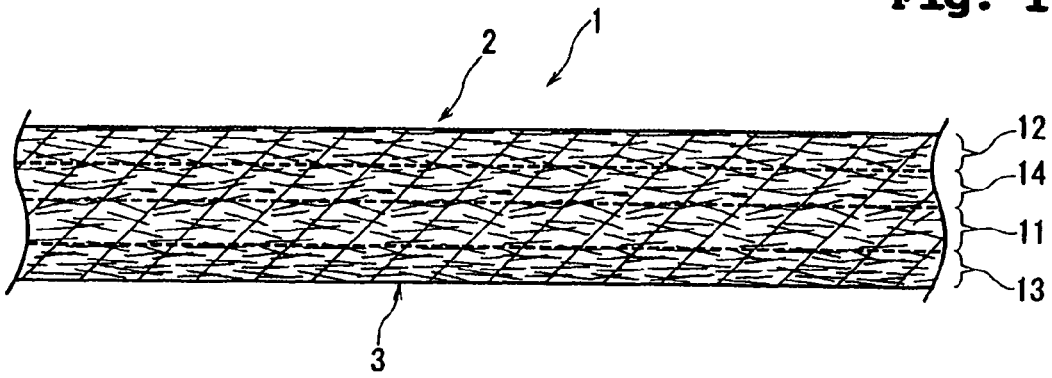
FIG. 1 is an enlarged sectional view of a wiper according to a first embodiment of the present invention.
Figure 2:
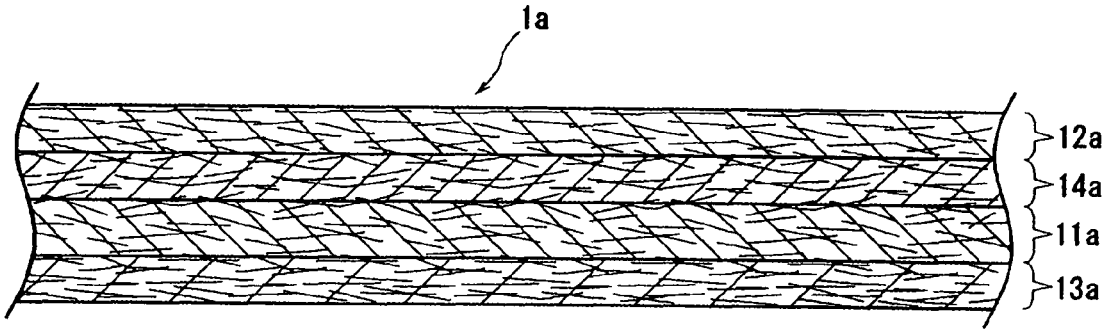
FIG. 2 is an enlarged sectional view of a multilayered fibrous web prepared in a process for manufacturing the wiper of the first embodiment.

FIG. 1 is an enlarged sectional view of a wiper 1 according to a first embodiment of the present invention; FIG. 2 is an enlarged sectional view of a multilayered fibrous web 1*a* prepared in the process for manufacturing the wiper 1; and FIG. 3 is an enlarged sectional view schematically showing the internal structure of the wiper 1.

First of all, fibers constituting layers of the wiper 1 will be described. Fibers as used herein are broadly divided into "fusible fiber" and "non-fusible fiber". The term "non-fusible fiber" includes "hydrophilic fiber" and "hydrophobic fiber". The term "hydrophilic fiber" includes "cellulosic fiber" and "synthetic resin fiber treated to be hydrophilic". That is, the term "non-fusible fiber" refers to fiber whose surface has a higher melting point than that of the "fusible fiber" or is not allowed to melt. Meanwhile, the term "fusible fiber" includes synthetic resin fiber treated to be hydrophilic and hydrophobic fibers (hydrophobic synthetic resin fibers).

Referring to FIG. 1, the wiper 1, being a single nonwoven fabric, has a first sheet surface 2 and a second sheet surface 3. The wiper 1 is intended to be supplied as a wet tissue premoistened with water or chemicals or a dry tissue capable of absorbing water during use. It may also be used for wiping a toilet, kitchen fixtures, furniture and so on in a dry or premoistened state. The wiper 1 may be used for wiping in any suitable manner. For example, two or more sheets of wiper 1 may be stacked and folded.

Figure 3:
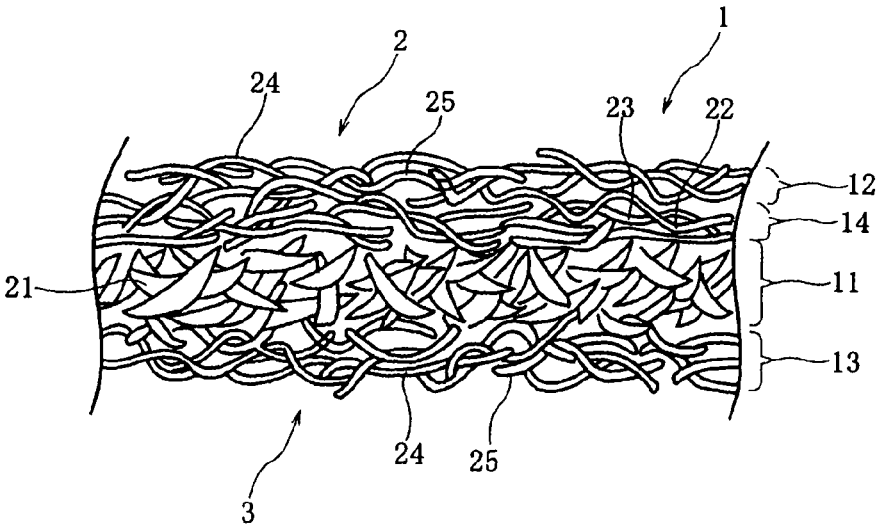
FIG. 3 is an enlarged sectional view schematically showing the internal structure of the wiper of the first embodiment.

As shown in FIGS. 1 and 3, the wiper 1 can be divided into four layers: an interlining layer 11; a first surfacing layer 12 appearing on the first surface 2; a second surfacing layer 13 appearing on the second surface 3; and a reinforcing layer 14 located between the first surfacing layer 12 and the interlining layer 11.

As will be described later with reference to FIG. 2, the wiper 1 is manufactured by subjecting a multilayered fibrous web to a water-jet treatment and heat-treating the hydroentangled fibrous web. Where water jets are applied, fibers tend to be entangled not only within the individual layers but also across the layers. Where water jets are applied, furthermore, hydrophilic fibers such as pulp having a fiber length equal to or less than 10 mm, e.g., in the range of 0.3-10 mm or 1-10 mm, tend to migrate to another layer (or mix with other fibers) due to high pressure of water streams.

Accordingly, it is likely that the interlining layer 11, the first surfacing layer 12, the second surfacing layer 13 and the reinforcing layer 14 cannot be clearly divided, and therefore in FIG. 1, boundaries between the layers are indicated by dashed lines. Thus, the first surfacing layer, the second surfacing layer, the interlining layer and the reinforcing layer according to the invention may have ill-defined boundaries.

The interlining layer 11 is mainly constituted of hydrophilic fibers. For the hydrophilic fibers, there may be used natural fibers such as pulp and cotton (cellulosic fibers) having a fiber length equal to or less than 10 mm, for example in the range of 1-10 mm, and regenerated fibers such as rayon (cellulosic fibers) having a fiber length in the range of 20-70 mm. It is also possible to use synthetic resin fibers that are treated to be hydrophilic such as by applying a hydrophilizing agent, e.g., surfactant to the fiber surface or kneading the material resin with such a hydrophilizing agent. Among them, preferably used are the natural fibers. It should be noted that the interlining layer 11 may contain hydrophobic synthetic resin fibers to such a degree as not to impair water retentivity.

The reinforcing layer 14 is mainly constituted of fusible fibers alone or in combination with the hydrophilic fibers. The fusible fibers have a low-melting resin such as polyethylene or low-melting polypropylene appearing on their surface. Examples of the fusible fibers include monocomponent fibers of polyethylene, monocomponent fibers of polypropylene, sheath/core bicomponent fibers of which the core is polyethylene terephthalate and the sheath is polyethylene, sheath/core bicomponent fibers of which the core is polypropylene and the sheath is polyethylene, sheath/core bicomponent fibers of which the core is high-melting polypropylene and the sheath is low-melting polypropylene, side-by-side bicomponent fibers composed of polyethylene terephthalate and polyethylene, and side-by-side bicomponent fibers composed of polypropylene and polyethylene.

The first surfacing layer 12 and the second surfacing layer 13 are mainly constituted of non-fusible fibers. The non-fusible fibers may be synthetic resin fibers whose surface has a higher melting point than that of the above-mentioned fusible fiber, preferably by 20 degrees centigrade. Examples of the non-fusible synthetic resin fibers include polypropylene fibers, polyethylene terephthalate fibers and nylon fibers. Preferably, these fibers are hydrophobic. In addition, or alternatively, cellulosic fibers, preferably regenerate fibers such as rayon having a fiber length in the range of 20-70 mm, may be used as the non-fusible fibers. If desired, the first surfacing layer 12 and the second surfacing layer 13 may be of different kinds of fibers or different blending ratios.

If the non-fusible fibers constituting the first and second surfacing layers 12 and 13 are only the hydrophobic synthetic resin fibers or the blending ratio of the hydrophobic synthetic resin fibers to total weight of the non-fusible fibers constituting the first and second surfacing layers 12 and 13 is equal to or greater than 60%, the sheet surface can be prevented from being excessively moistened (or soaked) with water or chemicals oozing out of the interlining layer 11 when the wiper is used in a pre-moistened state. This also results in preventing a sticky feeling to the skin, as well as undesirable adhesion of the wiper to an object to be cleaned or another wiper.

If the non-fusible fibers constituting the first and second surfacing layers 12 and 13 are only the hydrophilic cellulosic fibers or the blending ratio of the hydrophilic cellulosic fibers to total weight of the non-fusible fibers constituting the first and second surfacing layers 12 and 13 is equal to or greater than 60%, on the other hand, water adhered to the skin or another object to be cleaned can be readily absorbed and introduced into the interlining layer 11 when the wiper is used in a dry state.

Through a water-jet treatment, these layers 11-14 are integrated into a single nonwoven fabric. If the interlining layer 11 is mainly constituted of cellulosic fibers such as pulp, the cellulosic fibers can also be bound to each other through hydrogen bonding due to the presence of hydroxyl group on fiber surface.

The fusible fibers are fusion-bonded to each other or to the other fibers. Fusion bonds due to the fusible fibers can be found mainly in the reinforcing layer 14. On the other hand, the non-fusible fibers are kept in a relatively freely movable state.

FIG. 3 schematically shows an exemplary structure of the wiper 1. In this embodiment, the interlining layer 11 is constituted of pulp fibers 21, the reinforcing layer 14 is constituted of fusible fibers 22 and rayon fibers (cellulosic fibers) 23 having a fiber length in the range of 20-70 mm. The fusible fibers 22 are fusion-bonded to each other or to the rayon fibers 23. The first surfacing layer 12 and the second surfacing layer 13 are constituted of non-fusible hydrophobic synthetic resin fibers 24 and rayon fibers (cellulosic fibers) 25 having a fiber length in the range of 20-70 mm. Thus, the first and second surfaces 2 and 3 of the wiper 1 are mainly formed of the synthetic resin fibers 24 and the rayon fibers 25, which are both non-fusible fibers, and are completely or substantially free from the fusible fibers 22. That is, even if the fusible fibers 22 appear on the first and second surfaces 2 and 3, the ratio of the fusible fibers 22 to the non-fusible fibers is too small to have any effect on the first and second surfaces 2 and 3.

Here, the density of the pulp fibers 21 in the interlining layer 11 is higher than the fiber densities of the first surfacing layer 12, the second surfacing layer 13 and the reinforcing layer 14.

Next, a method for manufacturing the wiper 1 will be described.

The multilayered fibrous web la shown in FIG. 2 is formed on a conveyor belt of a net, which is generally called "wire", or a conveyor belt of a perforated plate (not shown). The multilayered fibrous web la is formed by stacking a second surfacing layer-forming fibrous web 13*a*, an interlining layer-forming fibrous web 11*a*, a reinforcing layer-forming fibrous web 14*a* and a first surfacing layer-forming fibrous web 12*a* in the order named above upwardly from the conveyor belt.

The second surfacing layer-forming fibrous web 13*a*, the first surfacing layer-forming fibrous web 12*a* and the reinforcing layer-forming fibrous web 14*a* are all formed by depositing fibers by a carded process. Both the second surfacing layer-forming fibrous web 13*a* and the first surfacing layer-forming fibrous web 12*a* are only of non-fusible fibers. More specifically, the fibrous webs 12*a*, 13*a* are formed of a blend of 50-100 wt. % of hydrophobic synthetic resin fibers and 0-50 wt. % of rayon fibers (hydrophilic fibers) having a fiber length in the range of 20-70 mm. On the other hand, the fibrous web 14*a* is formed of a blend of 50-100 wt. % of fusible fibers and 0-50 wt. % of rayon fibers (hydrophilic fibers) having a fiber length in the range of 20-70 mm.

The interlining layer-forming fibrous web 11*a* is formed only of hydrophilic fibers having a fiber length equal to or less than 10 mm, e.g., in the range of 0.3-10 mm or 1-10 mm. For example, at least either of pulp or cotton may be deposited by air-forming.

The multilayered fibrous web 1*a* thus formed on the conveyor belt is then subjected to water jets which are applied from above the first surfacing layer-forming fibrous web 12*a* and optionally from below the second surfacing layer-forming fibrous web 13*a*, thereby integrating the fibrous webs into a single nonwoven fabric.

Thereafter, the obtained nonwoven fabric is heat-treated, wherein the heating temperature is set to melt the surface of the fusible fibers but not melt the surface of the non-fusible fibers. Through the heat treatment, the fusible-fibers are fusion-bonded to each other or to the other fibers. Since the fusible fibers are initially contained only in the reinforcing layer-forming fibrous web 14*a*, the fusion-bonded fibers are present mainly in the reinforcing layer 14 of the completed wiper 1. Moreover, since the reinforcing layer 14 is adjacent to the interlining layer 11, the pulp fibers etc. in the interlining layer 11 can also be held by heat-bonding power of the fusible fibers in the reinforcing layer 14, which contributes to increased sheet strength, particularly increased wet strength.

The wiper 1 of FIGS. 1 and 3 is highly retentive of water due to the presence of hydrophilic fibers such as pulp in the interlining layer 11. In addition, since the interlining layer 11 has a higher fiber density than not only the first and second surfacing layers 12, 13 but also the reinforcing layer 14, the wiper 1 is allowed to retain much water in the interlining layer 11. Furthermore, hydrophilic fibers such as rayon contained in the first and second surfacing layers 12, 13 and the reinforcing layer 14 also contribute to high water retentivity of the wiper 1 and facilitate migration of water between the sheet center and the sheet surfaces 2, 3. Since the fusible fibers hardly appear on the first and second surfaces 2, 3, as set forth above, the first and second surfaces 2, 3 can be made soft, for example, so as not to irritate the skin when used for wiping the human body. In addition, the coefficient of friction between the first and second surfaces 2, 3 and an object to be cleaned is lowered to facilitate sliding.

In the wiper 1, the fusible fibers, which are fusion-bonded to each other or to the other fibers in the reinforcing layer 14 as well as to the fibers constituting the first surfacing layer 12 and the interlining layer 11, contribute to the increased sheet strength, particularly the increased wet strength.

The wiper 1 has a basis weight in, but not limited to, the range of 30 to 100 g/m$^2$, wherein the interlining layer 11 may have a basis weight in the range of 10 to 60 g/m$^2$ and the reinforcing layer 14 have a basis weight in the range of 5 to 50 g/m$^2$.

Figure 4:
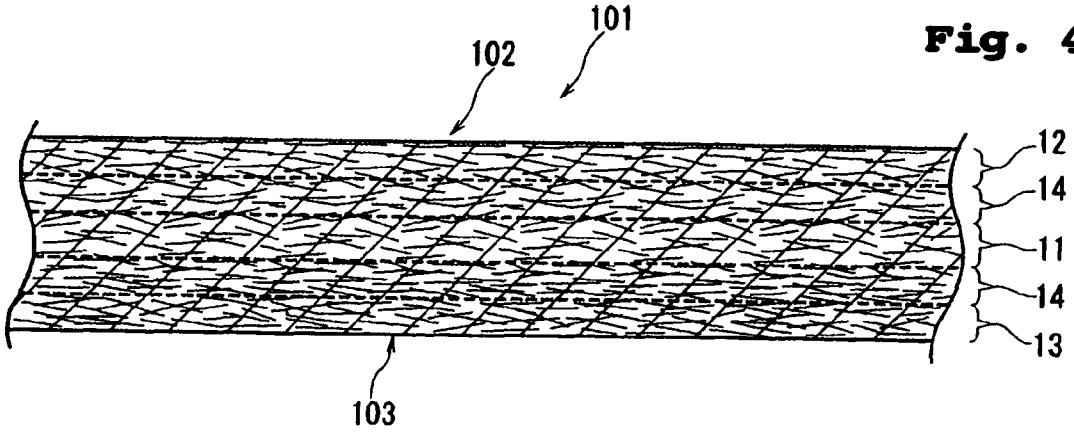
FIG. 4 is an enlarged sectional view of a wiper according to a second embodiment of the present invention.
Figure 5:
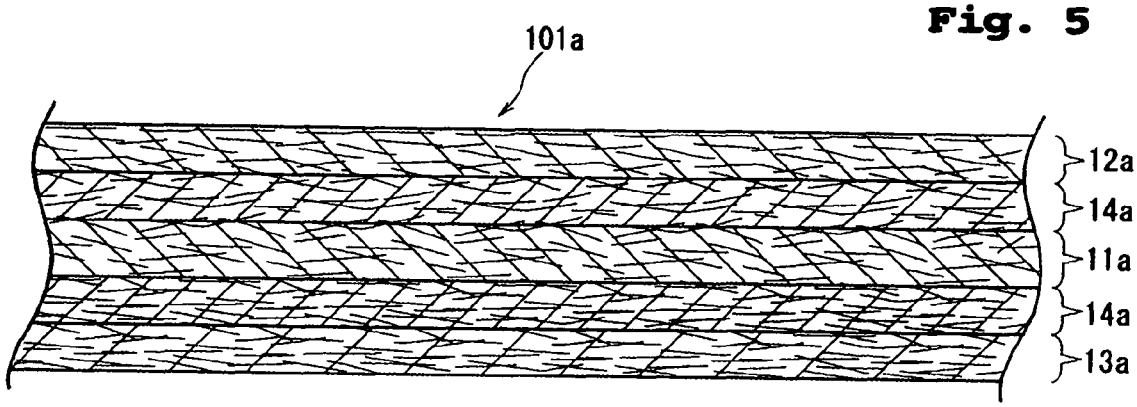
FIG. 5 is an enlarged sectional view of a multilayered fibrous web prepared in a process for manufacturing the wiper of the second embodiment.

FIG. 4 is an enlarged sectional view of a wiper 101 according to a second embodiment of the present invention, and FIG. 5 is an enlarged sectional view of a multilayered fibrous web 101*a* prepared in the process for manufacturing the wiper 101.

The wiper 101 of FIG. 4 includes two reinforcing layers 14, 14 on both sides of the interlining layer 11, wherein one reinforcing layer 14 is covered with the first surfacing layer 12 and the other reinforcing layer 14 is covered with the second surfacing layer 13.

As shown in FIG. 5, the multilayered fibrous web 101*a* is formed by stacking a second surfacing layer-forming fibrous web 13*a*, a reinforcing layer-forming fibrous web 14*a*, an interlining layer-forming fibrous web 11*a*, a reinforcing layer-forming fibrous web 14*a* and a first surfacing layer-forming fibrous web 12*a* one on top of the other.

The individual fibrous webs are constituted in the same manner as in the first embodiment and the wiper 1 is manufactured also in the same manner as in the first embodiment.

Since the reinforcing layers 14, 14, in which the fusible fibers are fusion-bonded as set forth above, are provided on both sides of the interlining layer 11, the sheet strength of the wiper 101 according to the second embodiment can be further enhanced. When the interlining layer 11 containing pulp fibers or the like is moistened with water, hydrogen bonding between the pulp fibers or the like tends to be weakened. In the wiper 101, however, the sheet strength can be maintained more reliably even in a moistened state because the fusion-bonded reinforcing layers 14, 14 are disposed on both side of the interlining layer 11.

Although the present invention has been illustrated and described with respect to exemplary embodiments thereof, it should be understood by those skilled in the art that the foregoing and various other changes, omission and additions may be made therein and thereto, without departing from the spirit and scope of the present invention. For example, two or more interlining layers 11 may be provided in the wiper such that the second surfacing layer 13, the interlining layer 11, the reinforcing layer 14, the interlining layer 11 and the first surfacing layer 12 are stacked one on top of the other or such that the second surfacing layer 13, the interlining layer 11, the reinforcing layer 14, the interlining layer 11, the reinforcing layer 14 and the first surfacing layer 12 are stacked one on top of the other. It is also possible to stack the second surfacing layer 13, the reinforcing layer 14, the interlining layer 11, the reinforcing layer 14, the interlining layer 11, the reinforcing layer 14 and the first surfacing layer 12 one on top of the other.

The present invention should not be understood as limited to the specific embodiments set out above but to include all possible embodiments which can be embodied within a scope encompassed and equivalent thereof with respect to the feature set out in the appended claims.

What is claimed is:

1. A wiper in the form of a sheet comprising:

a first surfacing layer appearing on one sheet surface;

a second surfacing layer appearing on the other sheet surface;

a reinforcing layer comprising fusible fibers; and an interlining layer pre-moistened with liquid and comprising hydrophilic fibers, including one of pulp or cotton, the reinforcing layer and the interlining layer being located between the first and second surfacing layers, wherein the first and second surfacing layers comprising non-fusible fibers whose surface has a higher melting point than that of the fusible fibers of the reinforcing layer, the non-fusible fibers comprise a blend of 50-100 wt % of hydrophobic synthetic resin fibers and a 0-50 wt % of hydrophilic fibers, wherein fibers in each of the first surfacing layer, the second surfacing layer, the reinforcing layer and the interlining layer are entangled both within each layer and across adjacent ones of the layers, such that the first surfacing layer, the second surfacing layer, the reinforcing layer and the interlining layer are thereby integrated as a single, nonwoven fabric, wherein the entangled fusible fibers are fusion-bonded while the entangled non-fusible fibers remain unfused, wherein the fusible fibers of the reinforcing layer that are entangled are heat-bonded with ones of the hydrophilic fibers of the interlining layer and the non-fusible fibers of the first and second surfacing layers, wherein the hydrophilic fibers contained in the interlining layer have a fiber length equal to or less than 10 mm and the interlining layer has a higher density than the first and second surfacing layers, wherein the higher density of the interlining layer promotes the liquid retention in the interlining layer, and wherein the non-fusible fibers constituting the first surfacing layer and the second surfacing layer include one or more of synthetic resin fibers or cellulosic fibers having a fiber length in the range of 20 to 70 mm.

2. A wiper according to claim 1, wherein the reinforcing layer contains non-fusible fibers in addition to the fusible fibers.

3. A wiper according to claim 1, wherein the fibers are entangled by a water-jet treatment.

4. A wiper according to claim 1, wherein the pulp fibers or cotton fibers of the interlining layer are substantially fixed by a heating-bonding power of the fusible fibers in the reinforcing layer.

5. A wiper in the form of a wet sheet comprising:

a first surfacing layer disposed on one sheet surface;

a second surfacing layer disposed on the other sheet surface;

a first reinforcing layer comprising fusible fibers;

a second reinforcing layer comprising fusible fibers; and an interlining layer pre-moistened with a liquid and comprising hydrophilic fibers including one of pulp or cotton, the first and second reinforcing layers and the interlining layer being disposed between the first and second surfacing layers, wherein the first and second surfacing layers comprise non-fusible fibers whose surface has a higher melting point than that of the fusible fibers of the reinforcing layer, the non-fusible fibers comprise a blend of 50-100 wt % of hydrophobic synthetic resin fibers and a 0-50 wt % of hydrophilic fibers, wherein fibers in each of the first surfacing layer, the second surfacing layer, the first and second reinforcing layer, and the interlining layer are entangled both within each layer and across adjacent ones of the layers, such that the first surfacing layer, the second surfacing layer, the first reinforcing layer, the second reinforcing layer, and the interlining layer are thereby integrated as a single, nonwoven fabric, wherein the entangled fusible fibers are fusion-bonded while the entangled non-fusible fibers remain unfused, wherein the fusible fibers of the first and second reinforcing layer that are entangled are heat-bonded with ones of the hydrophilic fibers of the interlining layer and the non-fusible fibers of the first and second surfacing layers, wherein the hydrophilic fibers contained in the interlining layer have a fiber length equal to or less than 10 mm and the interlining layer has a higher density than the first and second surfacing layers, wherein the higher density of the interlining layer promotes the liquid retention in the interlining layer, and wherein the non-fusible fibers constituting the first surfacing layer and the second surfacing layer include one or more of synthetic resin fibers or cellulosic fibers having a fiber length in the range of 20 to 70 mm.

6. A wiper according to claim 5, wherein the interlining layer is disposed between the first and second reinforcing layers.

7. A wiper according to claim 5, wherein each of the first and second reinforcing layers contain non-fusible fibers in addition to the fusible fibers.

8. A wiper according to claim 5, wherein the fibers are entangled by a water jet treatment.

9. A wiper according to claim 5, wherein the pulp fibers or cotton fibers of the interlining layer are substantially fixed by a heating-bonding power of the fusible fibers in the first and second reinforcing layer.

10. A wiper according to claim 1, wherein the first surfacing layer and the second surfacing layer comprise rayon fiber.

11. A wiper according to claim 2, wherein the non-fusible fibers are rayon fibers having a fiber length in the range of 20 to 70 mm.

12. A wiper according to claim 7, wherein the non-fusible fibers are rayon fibers having a fiber length in the range of 20 to 70 mm.

13. A wiper according to claim 1, wherein the non-fusible fibers in the first and second surfacing layers comprise 60-100 wt % of hydrophobic synthetic resin fibers.

14. A wiper according to claim 5, wherein the non-fusible fibers in the first and second surfacing layers comprise 60-100 wt % of hydrophobic synthetic resin fibers.

* * * * *